US012692043B2

(12) United States Patent
Chezem

(10) Patent No.: US 12,692,043 B2
(45) Date of Patent: Jul. 28, 2026

(54) HOUSEHOLD APPLIANCE PACKAGING ASSEMBLY

(71) Applicant: Haier US Appliance Solutions, Inc., Wilmington, DE (US)

(72) Inventor: Michael Thomas Chezem, Georgetown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 8 days.

(21) Appl. No.: 18/756,797

(22) Filed: Jun. 27, 2024

(65) Prior Publication Data

US 2026/0001680 A1 Jan. 1, 2026

(51) Int. Cl.
*B65D 19/20* (2006.01)
*B65D 85/68* (2006.01)

(52) U.S. Cl.
CPC ..... *B65D 19/20* (2013.01); *B65D 85/68* (2013.01); *B65D 2519/00019* (2013.01); *B65D 2519/00159* (2013.01); *B65D 2585/6855* (2013.01)

(58) Field of Classification Search
CPC ..... B65D 5/42; B65D 5/4208; B65D 5/46; B65D 5/46088; B65D 5/46096; B65D 5/4612; B65D 5/46152; B65D 19/20; B65D 23/102; B65D 25/24; B65D 25/282; B65D 25/2852; B65D 25/2858; B65D 25/2861; B65D 25/2864; B65D 25/2885; B65D 25/2888; B65D 85/68; B65D 2519/00791; B65D 2585/6817; B65D 2585/6845; B65D 2585/6847; B65D 2585/6852; B65D 2585/6855; B65D 2585/6857
USPC ..... 206/320, 521
See application file for complete search history.

(56) References Cited

U.S. PATENT DOCUMENTS 3,072,313 A * 1/1963 Svendsen ..... B65D 81/054 206/320
3,907,241 A * 9/1975 Oglesby ..... B65D 25/24 206/320
4,241,892 A * 12/1980 Morris ..... B65D 25/24 206/320
5,361,900 A * 11/1994 Stringer ..... B65D 19/44 206/319
6,155,527 A * 12/2000 Muyskens ..... B65D 19/0002 248/346.03

(Continued)

FOREIGN PATENT DOCUMENTS

CN 2191826 Y 3/1995
CN 108238332 A * 7/2018 ..... B65D 81/052

(Continued)

*Primary Examiner* — Bryon P Gehman
(74) *Attorney, Agent, or Firm* — Dority & Manning, P.A.

(57) ABSTRACT

A household packaging assembly includes at least one-paper based packaging wall including a corrugated board. The corrugated board includes a first panel including a surface and a second panel including a surface and spaced apart from the first panel. Additionally, the corrugated board includes a corrugated cushion extending from the surface of the first panel to the surface of the second panel. Furthermore, the household packaging assembly includes a household appliance positioned on the paper-based packaging wall(s). The corrugated board supports and cushions the household appliance during transport of the household appliance. Additionally, the corrugated board comprises a paper composite.

15 Claims, 6 Drawing Sheets

(56) References Cited

U.S. PATENT DOCUMENTS

| | | | | |
|---|---|---|---|---|
| 12,006,106 | B2 * | 6/2024 | Paley | B65D 85/68 |
| 12,454,399 | B2 * | 10/2025 | Hagedorn | B65D 85/68 |
| 2008/0196633 | A1 | 8/2008 | Ho | |
| 2011/0132238 | A1 | 6/2011 | Jaegers et al. | |

FOREIGN PATENT DOCUMENTS

| | | | |
|---|---|---|---|
| EP | 0393804 | B1 | 11/1994 |
| IN | 202221034237 | A | 12/2023 |
| KR | 20150115419 | A | 10/2015 |

* cited by examiner

HOUSEHOLD APPLIANCE PACKAGING ASSEMBLY

FIELD OF THE DISCLOSURE

The present subject matter relates generally to a packaging assembly, and more particularly to a packaging assembly for a household appliance.

BACKGROUND OF THE DISCLOSURE

Household appliances (e.g., dishwashing appliances, refrigerator appliances, oven appliances, etc.) are available in a variety of configurations. Often, in order to ship household appliances, robust packaging assemblies are required. These packaging assemblies may be configured to protect the household appliances during shipping and handling of the household appliance. For instance, the packaging assemblies typically include some sort of cushioning to help absorb shock (e.g., from drops or impacts) that may be experienced during shipping and handling.

Commonly, expanded polystyrene (EPS) is utilized as cushioning for packaging assemblies of household appliances. However, challenges exist with the use of EPS as a cushioning. For example, while EPS is recyclable, it is typically only recyclable at specific drop off sites. This can cause inconveniences for a user as EPS often cannot be recycled through household recycling streams. Furthermore, EPS is often glued to a frame (e.g., a cardboard frame) of the packaging assembly. In such cases, even if the packaging assembly is brought to a drop off site, the packaging assembly can still end up in a landfill where they are not recycled as the EPS may be difficult and time consuming to separate from the frame. Additionally, EPS has a propensity to crumble or break apart during shipping. Additionally, loose pieces of EPS may cause a mess when a user unpacks their household appliance.

Accordingly, a packaging assembly for a household appliance that obviates one or more of the above-mentioned drawbacks would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a household appliance packaging assembly is provided. The household appliance packaging assembly includes at least one paper-based packaging wall including a corrugated board. The corrugated board includes first panel including a surface and a second panel including a surface. The second panel is spaced apart from the first panel. Additionally, the corrugated board includes a corrugated cushion extending from the surface of the first panel to the surface of the second panel. Furthermore, the household appliance packaging assembly includes a household appliance positioned on the at least one paper-based packaging wall. The corrugated board supports and cushions the household appliance during transport of the household appliance. Additionally, the corrugated board includes a paper composite.

In another exemplary aspect of the present disclosure, a method of assembling a household appliance packaging assembly is provided. The method includes assembling a corrugated board of a paper-based packaging wall that supports and cushions a household appliance during transport of the household appliance. Assembling the corrugated board includes positioning a corrugated paper composite cushion between a surface of a first paper composite panel and a second paper composite panel spaced apart from the first paper composite panel. Additionally, the method includes modifying the corrugated board to change a stiffness of the corrugated board.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
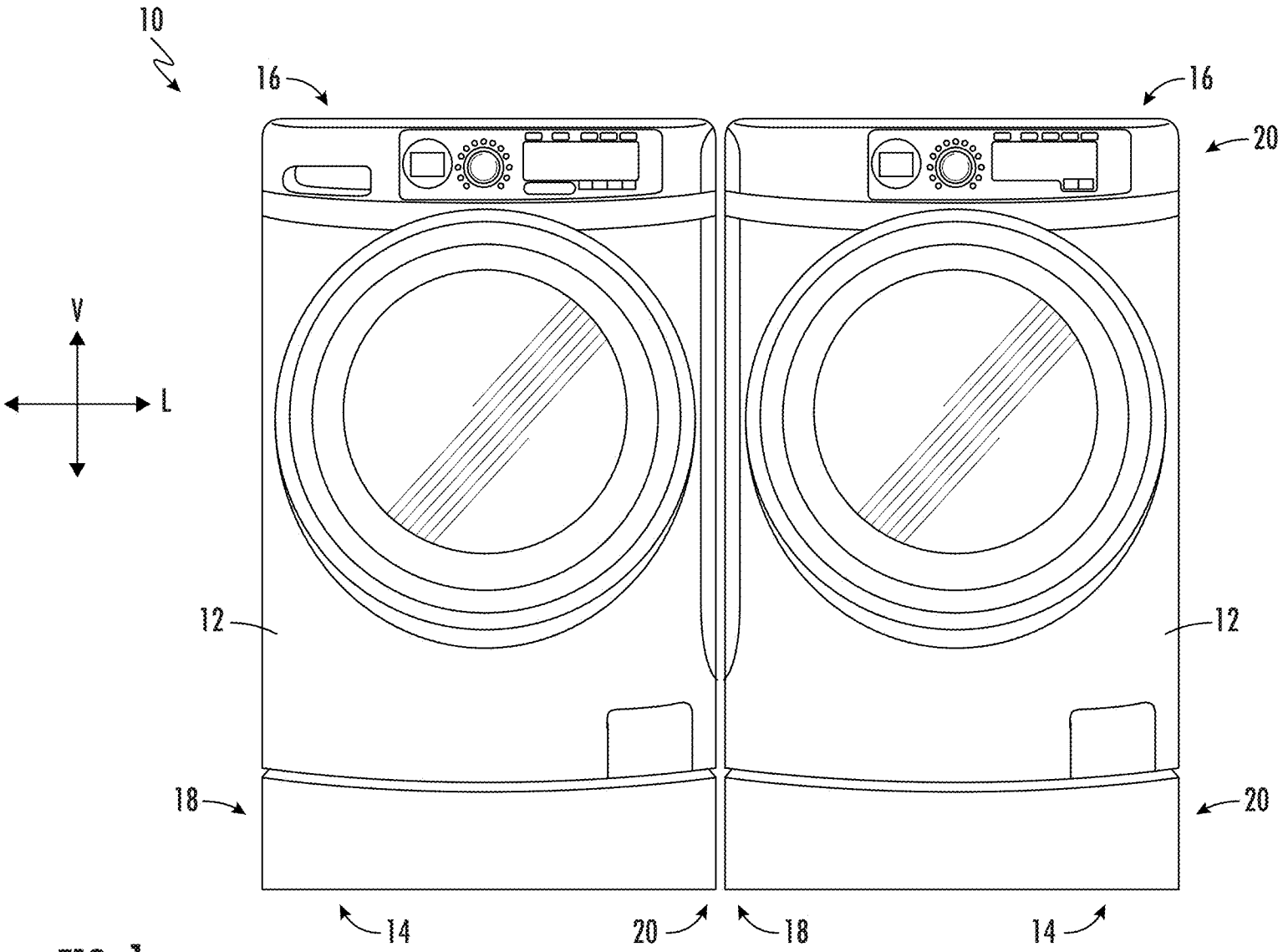
FIG. 1 provides a front view of exemplary household appliances, e.g., an exemplary washing machine appliance and an exemplary dryer appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Directional terms such as "left" and "right" are used herein with reference to the perspective of a user standing in front of a household appliance to access the appliance and/or items therein. Terms such as "inner" and "outer" refer to relative directions with respect to the interior and exterior of the appliance. For example, "inner" or "inward" refers to the direction towards the interior of the appliance. Terms such as "left," "right," "front," "back," "top," or "bottom" are used with reference to the perspective of a user accessing the appliance. For example, a user stands in front of the appliance to open the door(s) and reaches into the appliance to add, move, or withdraw items therein.

As used herein, the terms "first," "second," and "third" may be used interchangeably to distinguish one component from another and are not intended to signify location or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "includes" and "including" are intended to be inclusive in a manner similar to the term "comprising." Similarly, the term "or" is generally intended to be inclusive (i.e., "A or B" is intended to mean "A or B or both").

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Referring to the figures, an exemplary household appliance is illustrated in FIG. 1, e.g., the household appliance may, in various embodiments, be a laundry appliance such as a washing machine appliance or a dryer appliance as illustrated in FIG. 1. In various embodiments of the present subject matter, a laundry appliance may be any suitable laundry appliance, such as a washing machine appliance, a dryer appliance, a combination washer-dryer appliance, etc. The dryer appliance 11 is separately labelled in FIG. 1 to distinguish the dryer appliance 11 from the washing machine appliance 10, where both the washing machine appliance 10 and the dryer appliance 11 are example embodiments of a household appliance 10 which may be usable in one or more exemplary methods described herein and/or may be operable and configured to perform such methods.

According to various embodiments of the present disclosure, the household appliance 10 may be any of the example appliances described herein or may be any other household appliance. Thus, it will be understood that the present subject matter is not limited to any particular household appliance.

It should be understood that "household appliance" and/or "appliance" are used herein to describe appliances typically used or intended for common domestic tasks, such as a laundry appliance, e.g., as illustrated in FIG. 1, or an air conditioner appliance, a dishwashing appliance, a refrigerator, a water heater, etc., and any other household appliance which performs similar functions in addition to network communication and data processing. Thus, devices such as a personal computer, router, and other similar devices whose primary functions are network communication and/or data processing are not considered household appliances as used herein.

As generally seen throughout FIG. 1, in at least some embodiments, each laundry appliance 10 and 11 includes a cabinet 12 which defines a vertical direction V, a lateral direction L, and a transverse direction T that are mutually perpendicular. Each cabinet 12 extends between a top side 16 and a bottom side 14 along the vertical direction V. Each cabinet 12 also extends between a left side 18 and a right side 20, e.g., along the lateral direction L, and between a front side 22 and a rear side 24 along the transverse direction T.

Figure 2:
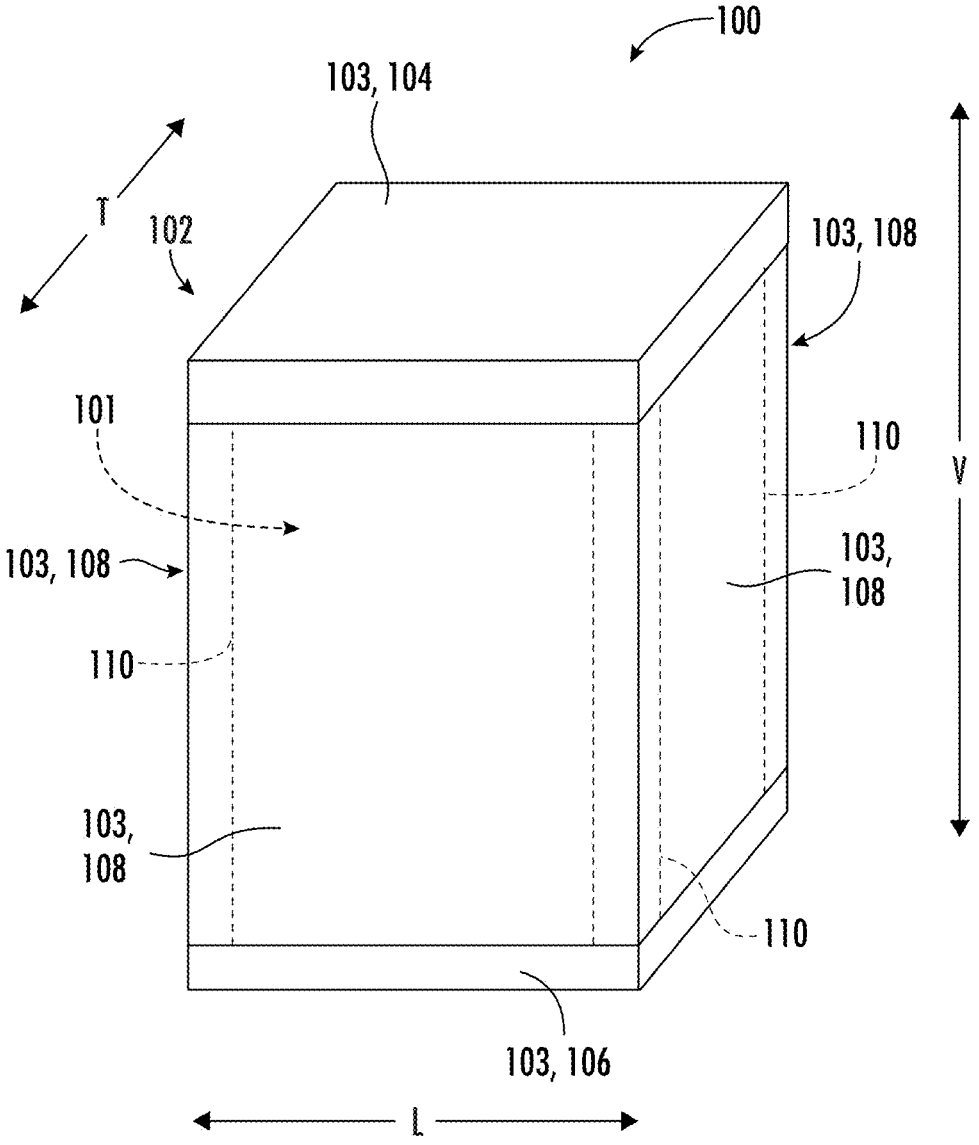
FIG. 2 provides a perspective view of a packaging according to one or more exemplary embodiments of the present disclosure.
Figure 3:
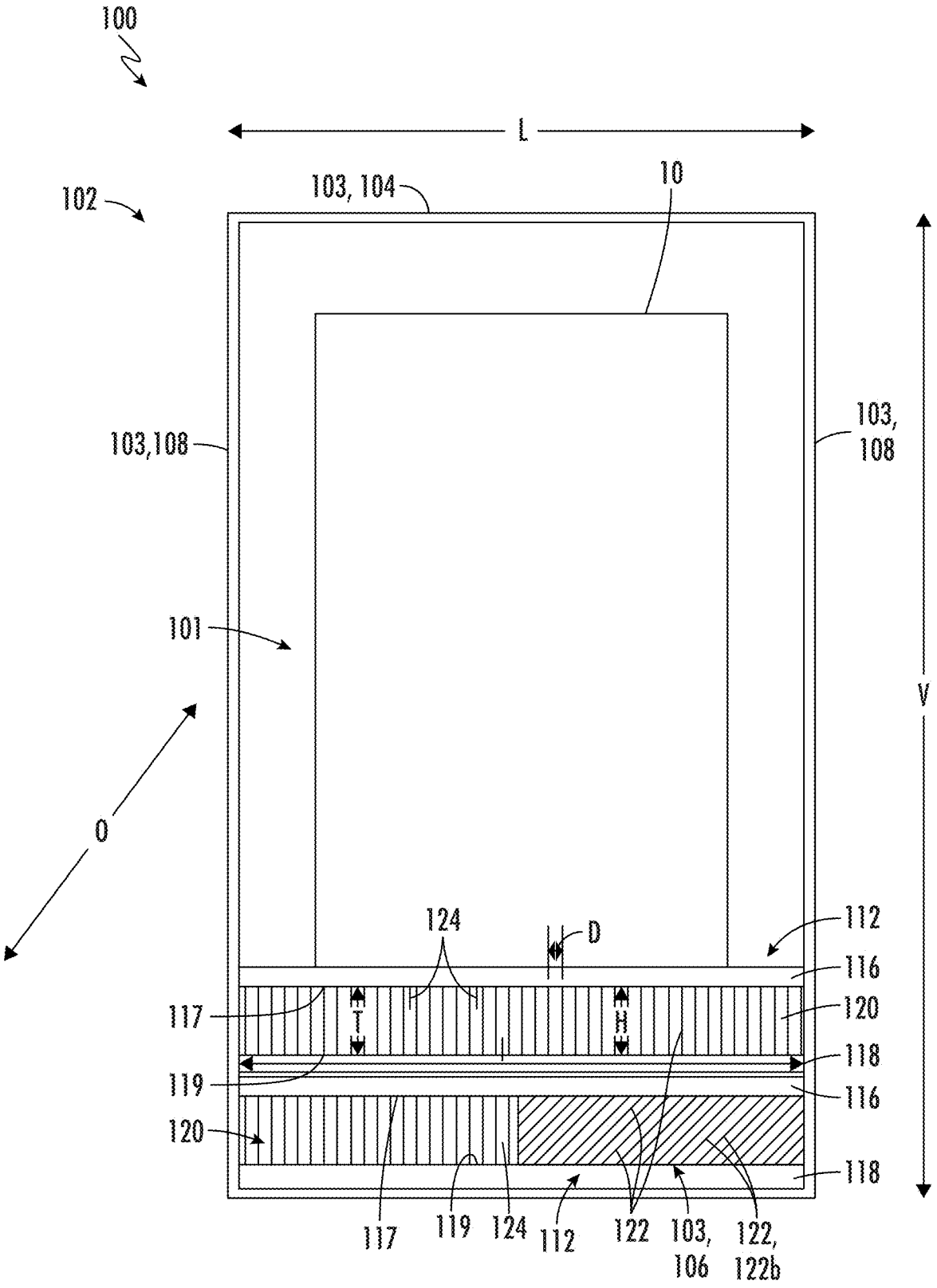
FIG. 3 provides a perspective view of the packaging assembly of FIG. 1 with a top pad removed.

Referring to FIGS. 2 and 3, an exemplary household appliance packaging assembly 100 for a household appliance, such as exemplary washing machine appliance 10 and/or dryer appliance 11 of FIG. 1, is provided. Specifically, FIG. 2 depicts a perspective view of household appliance packaging assembly 100 for a household appliance, FIG. 3 depicts a side view of a household appliance positioned within the exemplary household appliance packaging assembly 100 of FIG. 2.

As best illustrated in FIG. 2, packaging assembly 100 may include a corrugated package frame 102 that may include one or more frame components. For instance, corrugated package frame 102 may include one or more packaging walls 103 such as top pad wall 104, a skid or base pad wall 106, and/or a plurality of side walls 108. Furthermore, package frame 102 may include a plurality of corner post frames 110. Base pad wall 106 may be positioned below and spaced apart from top pad wall 104 in vertical direction V. Plurality of side walls 108 may be positioned apart from each other in a lateral direction L and/or transverse direction T and extend from base pad wall 106 to top pad wall 104 and connect base pad wall 106 and top pad wall 104. As such, package frame 102 may define an internal chamber 101 that may be complementary to a predetermined household appliance, e.g., a refrigerator, a dishwasher, etc.) of household appliance packaging assembly 100. As best illustrated in FIG. 3, a household appliance of household appliance packaging assembly 100, such as washing machine appliance 10, dryer appliance 11, or any other suitable household appliance, may be positioned within internal chamber 101 on top of base pad wall 106. In this respect, household appliance is at least partially enclosed by packaging wall(s) 103.

One or more of top pad wall 104, base pad wall 106, plurality of side walls 108, and/or plurality of corner post frames 110 may be constructed from one or more pieces of corrugated board 112 or have one or more pieces of corrugated board 112 position thereon to support and cushion a household appliance during transport/shipping, such as washing machine appliance 10, dryer appliance 11, or any other suitable household appliance. As illustrated in FIG. 3, base pad wall 106 is constructed of corrugated board 112. Corrugated board 112 may include one or more liners, such as the flat faces of the corrugated board 112. The liners may correspond to a first panel 116 and a second panel 118 spaced apart from first panel 116. For example, as illustrated in FIG. 3, first panel 116 of corrugated board 112 of base pad wall 106 may be spaced apart from and positioned above second panel 118 in vertical direction V. Additionally, first panel 116 may include an inner surface 117 and second panel 118 may include an inner surface 119 facing inner surface 117 of first panel 116. In addition, corrugated boards 112 may include a medium attached to the one or more liners. For example, corrugated board 112 may include first panel 116 and second panel 118 and a fluted medium, such as a corrugated cushion 120, attached between the two liners. As illustrated in FIG. 3, corrugated cushion 120 may extend between first panel 116 and second panel 118 from inner surface 117 of first panel 116 to inner surface 119 of second panel 118. As should be appreciated, the one or more liners and the medium may both be constructed from a paper-based material, such as cardboard or paper composite, as will be described below. In this regard, packaging wall(s) 103 of package frame 102 may be paper-based packaging wall(s) 103.

Figure 4:
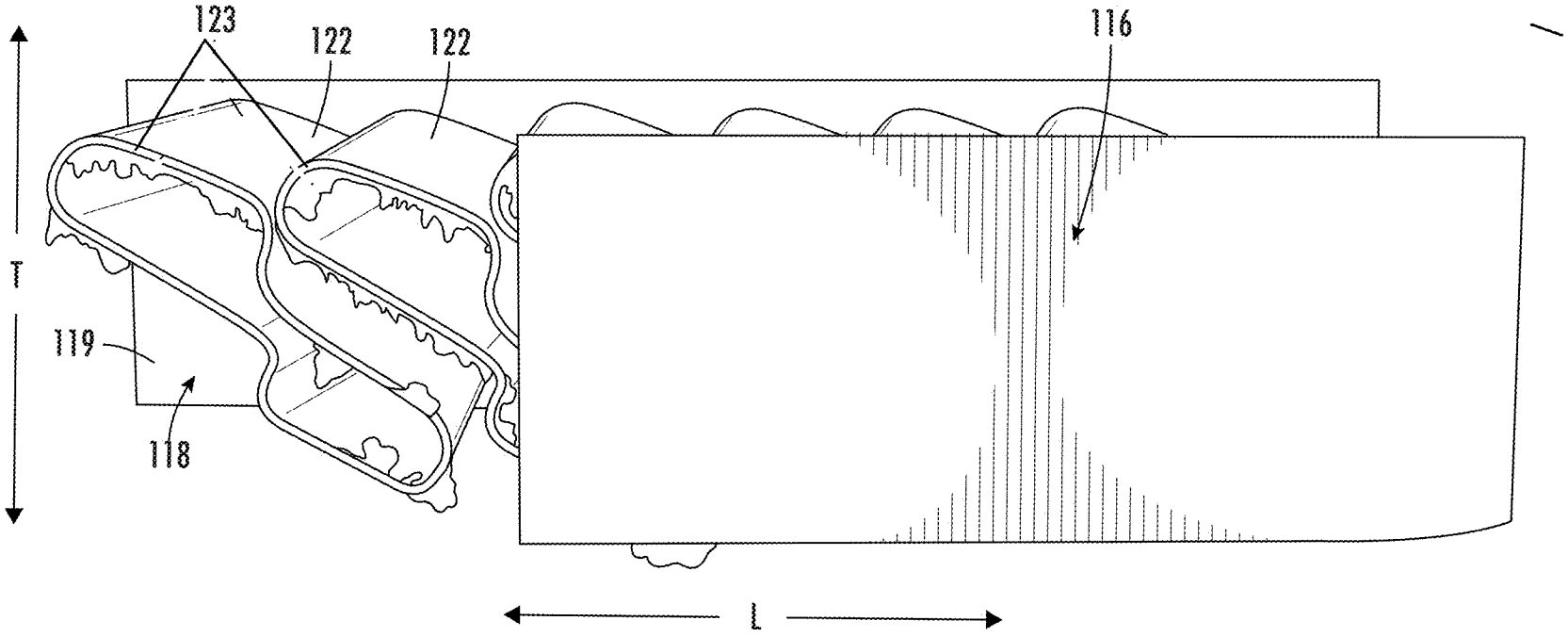
FIG. 4 provides a top view an example corrugated cushion of the example packaging assembly of FIG. 1 with a panel partially removed for clarity.
Figure 5:
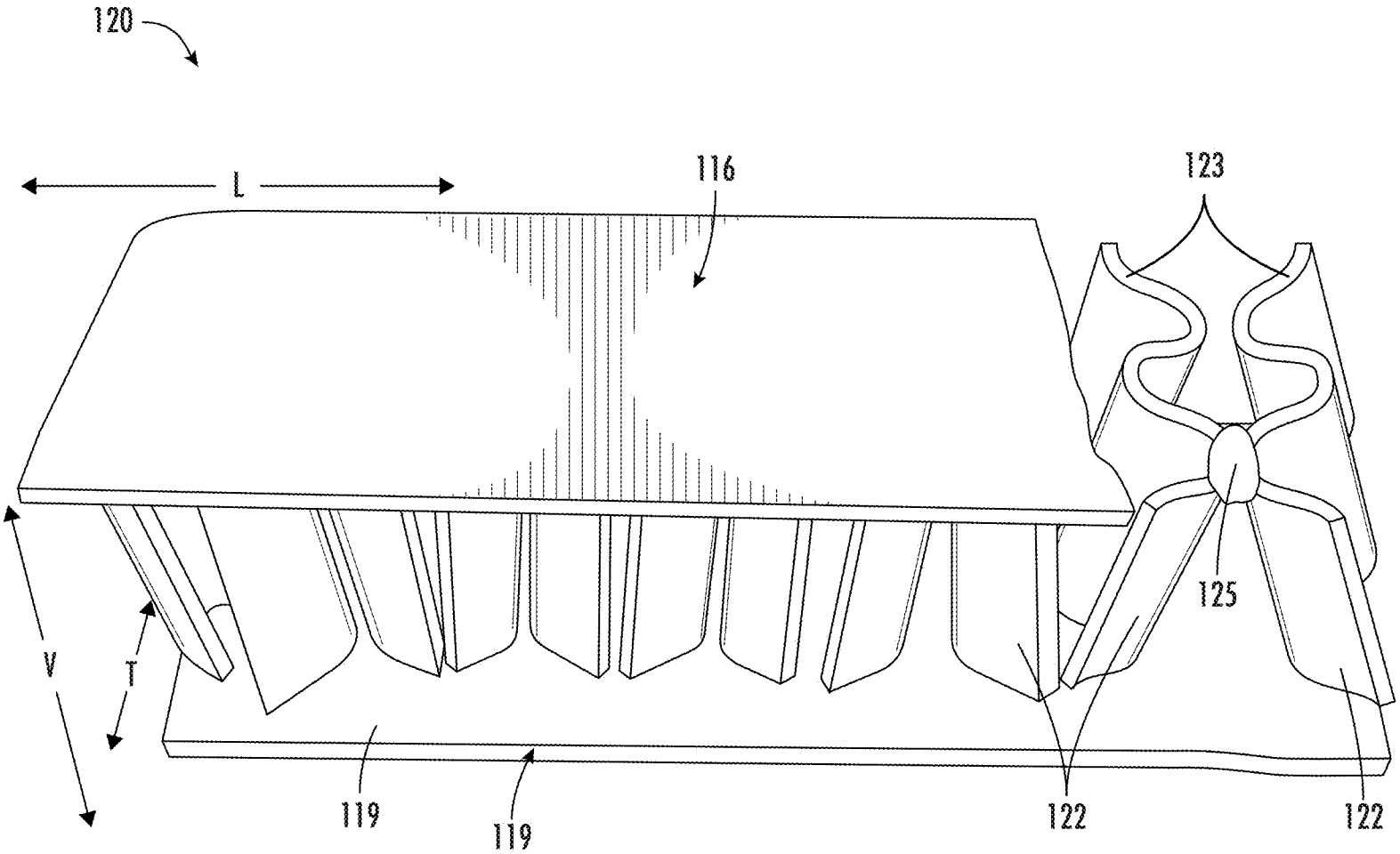
FIG. 5 provides a perspective view an example corrugated cushion of the example packaging assembly of FIG. 1 with a panel partially removed for clarity.

Furthermore, corrugated cushion 120 may define a fluted pattern (e.g., a corrugated, a wavy, or a serpentine pattern) of corrugated board 112. Particularly, fluted pattern of corrugated cushion 120 may give corrugated board 112 rigidity, strength, stiffness, and help prevent or mitigate crushing of corrugated board 112 while providing selected cushioning of household appliances. Corrugated cushion 120 may be adhered to adjacent liners, such as first panel 116 and/or second panel 118, for instance, with a corn starch-based adhesive. For example, as best illustrated in FIGS. 3 through 5, fluted pattern of corrugated cushion 120 may correspond to a plurality of corrugated layers 122 which may be spaced apart from each other along a length of inner surface 117 of first panel 116 and inner surface 119 of second panel 118. Plurality of corrugated layers 122 may be spaced apart from each other in lateral direction L. In some embodiments, plurality of corrugated layers 122 may be a repeating pattern of corrugated layers 122 (e.g., identical wave patterns) oriented in a same direction (FIG. 4). However, in some embodiments, some or all of corrugated layers 122 may be oriented differently (FIGS. 3, 5). For example, some corrugated layers 122 of base pad wall 106 are oriented in a first direction, such as vertically oriented layers 122A in vertical direction V. In this respect, an approximately right angle is defined between inner surface 117 of first panel 116 and vertically oriented layers 122A and between inner surface 119 of second panel 118 and vertically oriented layers 122A. Other corrugated layers 122 are oriented in a second direction, such as obliquely oriented layers 122B in oblique direction O. In this respect, an oblique angle is defined between obliquely oriented layers 122B and inner surface 117 of first panel 116 and between obliquely oriented layers 122B and inner surface 119 of second panel 118. Vertically oriented layers 122A may increase stiffness and support of corrugated cushion 120 and, thus, corrugated board 112 over obliquely oriented layers 122B, which decrease stiffness of corrugated cushion 120 and, thus, corrugated board 112 relative to vertically oriented layers 122A.

According to example embodiments, some or all of corrugated layers 122 may each be fabricated from an initial or prefabricated corrugated section (not shown). Prefabricated corrugated section and, thus, corrugated layers 122, may be constructed or manufactured from paper or paper-based material, such as paper composite. Prefabricated corrugated section may be formed by wrapping paper sheets about a roller or otherwise layering or stacking paper sheets on each other to increase a thickness of a cross-section of prefabricated corrugated section, a weight of prefabricated corrugated section, a surface area of prefabricated corrugated section, a density of prefabricated corrugated section, and/or the like. The cross-section of prefabricated corrugated section may be identical or substantially similar to that of each corrugated layer 122.

In some embodiments, prefabricated corrugated section may be fully cut into pieces corresponding to corrugated layers 122 or otherwise fully separated along its cross-section into separate corrugated layers 122. In some embodiments, separate corrugated layers 122 may be identical or substantially identical in dimensions (e.g., height, cross-section). For example, as illustrated in FIG. 4, each corrugated layer 122 is not directly coupled or connected to any of the other corrugated layers 122. Each corrugated layer 122 may include a cutting surface 123 (FIGS. 4, 5) along which each corrugated layer 122 was cut or otherwise separated from prefabricated corrugated section.

Additionally, or alternatively, in some embodiments, prefabricated corrugated section may be partially cut into pieces corresponding to corrugated layers 122 or otherwise partially separated along its cross-section into corrugated layers 122. In some embodiments, corrugated layers 122 may be identical or substantially identical in dimensions (e.g., height, cross-section). For example, as illustrated in FIG. 5, cutting surface 123 of each corrugated layer 122 may be directly coupled or connected to cutting surface 123 of a different, adjacent, corrugated layer 122 at a connection or linkage point 125. For example, linkage point 125 may thus correspond to a location in which cutting surfaces 123 of adjacent corrugated layers 122 are connected to each other. Such linkage points 125 may be created from a partial or incomplete cut through the cross-section of the prefabricated corrugated section. As illustrated in FIG. 5, adjacent corrugated layers 122 may be folded relative to each other at the linkage point 125. As such, stiffness of corrugated cushion 120 and, thus, corrugated board 112 may be increased relative to separated corrugated layers 122.

In some embodiments, corrugated board 112 may be configured as a plurality of corrugated boards 112 pieced together. For example, as illustrated in FIG. 3, base pad wall 106 may include a first corrugated board 112A and a second corrugated board 112B vertically stacked in vertical direction V. In this respect, second corrugated board 112B may be positioned above or directly on top of first corrugated board 112A. Plurality of corrugated boards 112 that are pieced together may provide increased stiffness and support for household appliances over a single corrugated board 112, for instance.

In some embodiments, corrugated cushion 120 may define a plurality of incisions 124 extending at least partially into corrugated cushion. For example, as illustrated in FIG. 3, incisions 124 may extend from a top and/or a bottom of one or more of corrugated layers 122 and into corrugated layers 122. Incisions 124 may decrease stiffness of corrugated cushion 120 and, thus, corrugated board 112 over no incisions 124 defined by corrugated cushion 120. Additionally, as will be described below in reference to a method of assembling a household appliance packaging assembly, incisions 124 may be made within corrugated cushion 120 using one or more cutting mechanisms or blades.

In some embodiments, corrugated board 112, such as first panel 116, second panel 118, and corrugated cushion 120, includes, or is formed as, a paper composite. The paper composite may include shredded paper material that is formed into a predetermined shape via a molding process, such as a wet molding process. The shredded paper material may include any suitable paper material that has been shredded (e.g., torn or cut into strips or fine particles). For example, the shredded paper material may be wastepaper or recycled paper material, such as newspaper, that has been shredded to a desired size or shape. Furthermore, in some embodiments, packaging wall(s) 103, which includes corrugated board 112, does not include thermoplastic foam material, such as expanded polystyrene (EPS) material.

Figure 6:
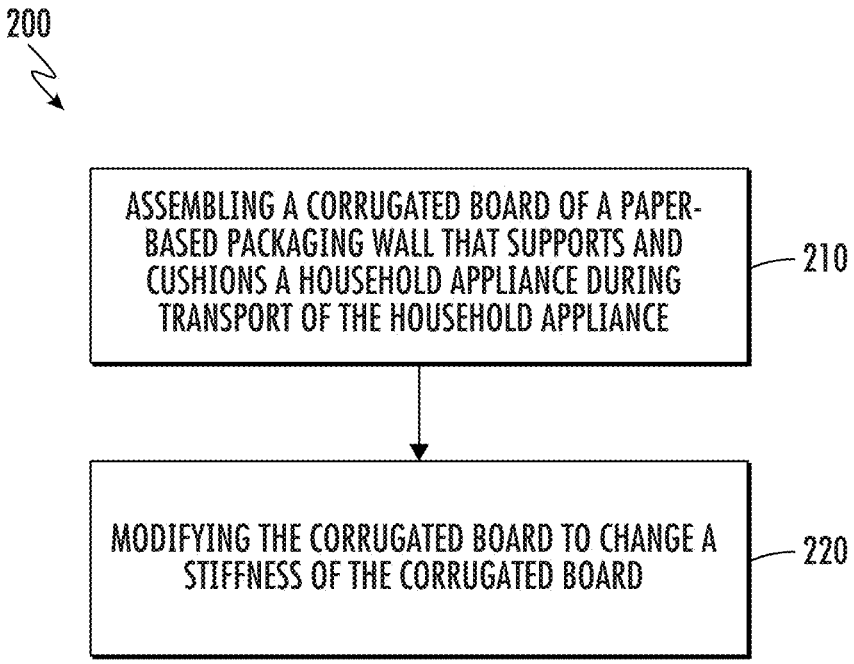
FIG. 6 illustrates a method for assembling a household appliance packaging assembly in accordance with one embodiment of the present disclosure.

Referring now to FIG. 6, one embodiment of a method 200 of assembling a household appliance packaging assembly will be described. In particular, the method 200 includes steps of assembling a household appliance packaging assembly to change the stiffness or rigidity of the household appliance packaging assembly to be used with specific household appliances. Household appliance packaging assemblies may need to be assembled or modified depending on a specific type of household appliance being shipped or transported in or on the household appliance packaging assembly. For example, some household appliances may weigh more than others and, thus, may need more support and less cushion than other household appliances and vice versa.

As shown in FIG. 6, at (210), method 200 includes assembling a corrugated board of a paper-based packaging wall that supports and cushions a household appliance during transport of the household appliance, which includes positioning a corrugated paper composite cushion between a surface of a first paper composite panel and a surface of second paper composite panel spaced apart from the first paper composite panel. For example, as described above, corrugated cushion 120 of base pad wall 106 includes or is formed as paper composite and may extend from inner surface 117 of first panel 116 to inner surface 119 of second panel 118.

Additionally, at (220), method 200 includes modifying the corrugated board to change a stiffness of the corrugated board. As described above, household appliance packaging assemblies, such as household appliance packaging assembly 100, may need to be modified depending on specific types of household appliances being shipped or transported in or on the household appliance packaging assemblies. For example, a stiffness of corrugated board 112 may be modified from a standardized or pre-set/pre-formed state of corrugated board 112 to increase or decrease the stiffness of corrugated board 112. When packaging assembly 100 is transporting heavier appliances, corrugated board 112 may be modified to increase the stiffness of corrugated board 112. Alternatively, when packaging assembly 100 is transporting lighter appliances, corrugated board 112 may be modified to decrease the stiffness of corrugated board 112.

In some embodiments, modifying corrugated board 112 of packaging wall(s) 103 includes performing a plurality of incisions on the corrugated cushion 120 including or formed of paper composite to decrease the stiffness of corrugated board 112. For example, one or more blades or other cutting mechanisms may be used to perform or cut a plurality of incisions 124 at least partially into corrugated cushion 120. As illustrated in FIG. 3, incisions 124 may extend from a top and/or a bottom of one or more of corrugated layers 122 and into corrugated layers 122. Performing or cutting incisions 124 may decrease stiffness of corrugated cushion 120 and, thus, corrugated board 112.

Additionally, or alternatively, in some embodiments, modifying corrugated board 112 of packaging wall(s) 103 includes decreasing a thickness of paper composite used for manufacturing the corrugated paper composite cushion to decrease the stiffness of the corrugated board. For example, as shown in FIG. 3, corrugated cushion 120 may have corrugated cushion thickness t, which corresponds to the thickness of the paper composite of which corrugated cushion 120 is manufactured from. As such, decreasing the thickness of the paper composite and, thus, decreasing corrugated cushion thickness t of corrugated cushion 120, decreases the stiffness of corrugated board 112.

Additionally, or alternatively, in some embodiments, modifying corrugated board 112 of packaging wall(s) 103 includes increasing a distance between each corrugated layer of a plurality of corrugated layers spaced apart from each other along a length of the surface of the first paper composite panel and the surface of the second paper composite panel to decrease the stiffness of the corrugated board. For example, as shown in FIG. 3, plurality of corrugated layers 122 of corrugated cushion 120 may be spaced apart from each other along a length of inner surface 117 of first panel 116 and inner surface 119 of second panel 118 in lateral direction L by a distance D. The closer together plurality of corrugated layers 122 are to each other, the higher the stiffness of corrugated board 112, while the further apart plurality of corrugated layers 122 are from each other, the lower the stiffness of corrugated board 112. As such, increasing the distance D between each corrugated layer 122 of corrugated cushion 120 decreases the stiffness of corrugated board 112.

Additionally, or alternatively, in some embodiments, modifying corrugated board 112 of packaging wall(s) 103 includes orienting at least some corrugated layers of a plurality of corrugated layers relative to the surface of the first paper composite panel and the surface of the second paper composite panel such that an oblique angle is defined between each corrugated layer and the surface of the first paper composite panel and the surface of the second paper composite panel to decrease the stiffness of the corrugated board. For example, as shown in FIG. 3, some corrugated layers 122 may be obliquely oriented layers 122B in oblique direction O. In this respect, an oblique angle is defined between obliquely oriented layers 122B and inner surface 117 of first panel 116 and between obliquely oriented layers 122B and inner surface 119 of second panel 118. Obliquely oriented layers 122B may decrease stiffness of corrugated board 112.

Additionally, or alternatively, in some embodiments, modifying corrugated board 112 of packaging wall(s) 103 includes orienting at least some corrugated layers of the plurality of corrugated layers relative to the surface of the first paper composite panel and the surface of the second paper composite panel such that an approximately right angle is defined between each corrugated layer and the surface of the first paper composite panel and the surface of the second paper composite panel to increase the stiffness of the corrugated board. For example, as shown in FIG. 3, some corrugated layers 122 may be vertically oriented layers 122A in vertical direction V. In this respect, an approximately right angle is defined between inner surface 117 of first panel 116 and vertically oriented layers 122A and between inner surface 119 of second panel 118 and vertically oriented layers 122A. Vertically oriented layers 122A may increase stiffness of corrugated board 112.

Additionally, or alternatively, in some embodiments, modifying corrugated board 112 of packaging wall(s) 103 includes decreasing a surface area of each of the first paper composite panel, the second paper composite panel, and the corrugated paper composite cushion to decrease the stiffness of the corrugated board. For example, as shown in FIG. 3, first panel 116, second panel 118, and corrugated cushion 120 may make up a surface area SA of corrugated board 112 which includes a length l corrugated board 112 in lateral direction L, a height H of corrugated board 112 in vertical direction V, and a width (not shown) of corrugated board 112 in transverse direction (not shown). Decreasing surface area SA of the first panel 116, second panel 118, and corrugated cushion 120, which may include decreasing length 1, height H, and/or width (not shown) decreases the stiffness of corrugated board 112.

Embodiments of the present subject matter advantageously provide a household appliance packaging assembly including one or more paper-based packaging walls. The exemplary packaging assembly is advantageously recyclable as it is constructed from paper-based materials unlike conventional packaging assemblies that include synthetic cushioning (e.g., packaging assemblies that may include expanded polystyrene). The paper-based packaging walls may be used to provide cushioning and support during shipping and handling of domestic or household appliances and may be modified to adjust the stiffness to accommodate specific appliance types.

This written description uses examples to disclose the invention, including the best mode, and also to enable any person skilled in the art to practice the invention, including making and using any devices or assemblies and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A household appliance packaging assembly, comprising:

at least one paper-based packaging wall including a corrugated board, the corrugated board including:

a first panel including a surface;

a second panel including a surface, the second panel spaced apart from the first panel; and a corrugated cushion extending from the surface of the first panel to the surface of the second panel, the corrugated cushion including a plurality of corrugated layers spaced apart from each other along a length of the surface of the first panel and the surface of the second panel; and a household appliance positioned on the at least one paper-based packaging wall, and wherein:

at least one corrugated layer of the plurality of corrugated layers of the corrugated cushion is oriented relative to the surface of the first panel and the surface of the second panel such that an oblique angle is defined between the at least one corrugated layer and each of the surface of the first panel and the surface of the second panel;

the corrugated board supports and cushions the household appliance during transport of the household appliance; and the corrugated board comprises a paper composite.

2. The household appliance packaging assembly of claim 1, wherein:

the at least one paper-based packaging wall is a plurality of paper-based packaging walls positioned relative to each other; and the household appliance is at least partially enclosed by the plurality of paper-based packaging walls during transport of the household appliance.

3. The household appliance packaging assembly of claim 1, wherein:

the corrugated board is positioned below the household appliance to support and cushion the household appliance.

4. The household appliance packaging assembly of claim 1, wherein:

the corrugated board is a plurality of vertically stacked corrugated boards positioned below the household appliance to support and cushion the household appliance.

5. The household appliance packaging assembly of claim 1, wherein:

the corrugated cushion of the at least one paper-based packaging wall defines a plurality of incisions extending partially into the corrugated cushion.

6. The household appliance packaging assembly of claim 1, wherein:

the at least one paper-based packaging wall does not comprise expanded polystyrene (EPS).

7. The household appliance packaging assembly of claim 1, wherein the paper composite comprises shredded paper material.

8. The household appliance packaging assembly of claim 7, wherein the shredded paper material is wastepaper or recycled paper.

9. A method of assembling a household appliance packaging assembly, comprising:

assembling a corrugated board of a paper-based packaging wall that supports and cushions a household appliance during transport of the household appliance, which includes positioning a corrugated paper composite cushion between a surface of a first paper composite panel and a surface of a second paper composite panel spaced apart from the first paper composite panel; and modifying the corrugated board to change a stiffness of the corrugated board, wherein modifying the corrugated board includes orienting at least one corrugated layer of a plurality of corrugated layers relative to the surface of the first panel and the surface of the second panel such that an oblique angle is defined between the at least one corrugated layer and the surface of the first panel and the surface of the second panel to decrease the stiffness of the corrugated board.

10. The method of claim 9, wherein:

modifying the corrugated board of paper-based packaging wall comprises modifying the corrugated board of the paper-based packaging wall to increase or decrease a stiffness of the corrugated board.

11. The method of claim 9, wherein:

modifying the corrugated board of the paper-based packaging wall includes performing a plurality of incisions on the corrugated paper composite cushion to decrease the stiffness of the corrugated board.

12. The method of claim 9, wherein:

modifying the corrugated board of the paper-based packaging wall includes decreasing a thickness of paper composite used for manufacturing the corrugated paper composite cushion to decrease the stiffness of the corrugated board.

13. The method of claim 9, wherein:

modifying the corrugated board of the paper-based packaging wall includes increasing a distance between each corrugated layer of a plurality of corrugated layers spaced apart from each other along a length of the surface of the first paper composite panel and the surface of the second paper composite panel to decrease the stiffness of the corrugated board.

14. The method of claim 9, wherein:

modifying the corrugated board of the paper-based packaging wall includes orienting at least some corrugated layers of a plurality of corrugated layers relative to the surface of the first paper composite panel and the surface of the second paper composite panel such that an approximately right angle is defined between each corrugated layer and the surface of the first paper composite panel and the surface of the second paper composite panel to increase the stiffness of the corrugated board.

15. The method of claim 9, wherein:

modifying the corrugated board of the paper-based packaging wall includes decreasing a surface area of the first paper composite panel, the second paper composite panel, and the corrugated paper composite cushion to decrease the stiffness of the corrugated board.

* * * * *